United States Patent [19]

Powers

[11] 4,267,781

[45] May 19, 1981

[54] PALLET AND POST CONSTRUCTION THEREFOR

[76] Inventor: Richard J. Powers, 4340 N. Marmora, Chicago, Ill. 60639

[21] Appl. No.: 61,674

[22] Filed: Jul. 30, 1979

[51] Int. Cl.[3] ..... B65D 19/26; B65D 19/40

[52] U.S. Cl. ..... 108/56.1; 108/56.3

[58] Field of Search ..... 108/51.1, 53.1, 56.3, 108/56.1, 57.1; 206/386, 599, 600

[56] References Cited

U.S. PATENT DOCUMENTS

| | | | |
|---|---|---|---|
| 2,918,241 | 12/1959 | Maher | 108/56.3 X |
| 3,438,342 | 4/1969 | Woolworth et al. | 108/56.3 |
| 3,610,172 | 10/1971 | Wharton | 108/56.3 |
| 3,685,463 | 8/1972 | Francis | 108/56.3 |
| 4,128,253 | 12/1978 | Powers | 108/56.1 |

FOREIGN PATENT DOCUMENTS

| | | | |
|---|---|---|---|
| 2502528 | 7/1976 | Fed. Rep. of Germany | 108/56.3 |

*Primary Examiner*—William E. Lyddane

*Attorney, Agent, or Firm*—Jakala, Knechtel, Valentino, Demeur & Dallas

[57] ABSTRACT

A pallet post which comprises a truncated, cone-shaped outer body and a cylindrical-shaped inner body encompassed by the outer body and attached thereto by a plurality of spaced-apart flanges. The post has a top wall on the larger end of the cone-shaped outer body, and the inner body has a portion extending beyond the outer body at at least the end thereof having the top wall. The inner body also has an axial bore extending through it. The post is secured to a pallet by extending the shaft portion of a rivet having an enlarged head through a hole in the pallet into the axial bore in the inner body of the post. The extend portion or portions of the inner body of the post are disposed within the holes in the pallet to provide additional support.

10 Claims, 6 Drawing Figures

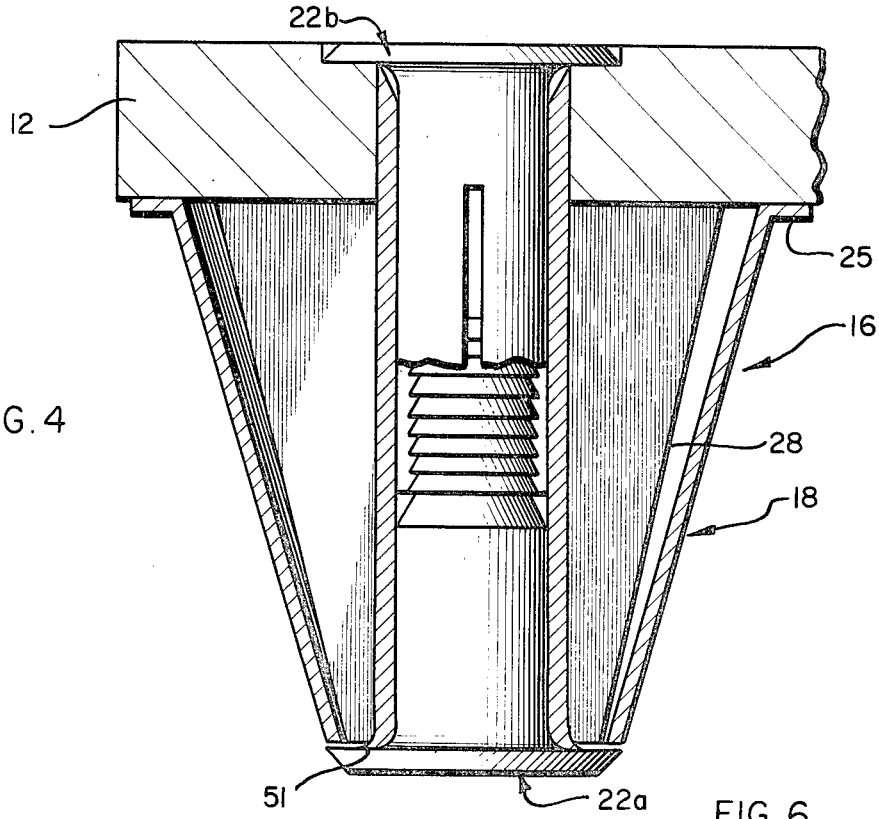
FIG. 4
FIG. 5
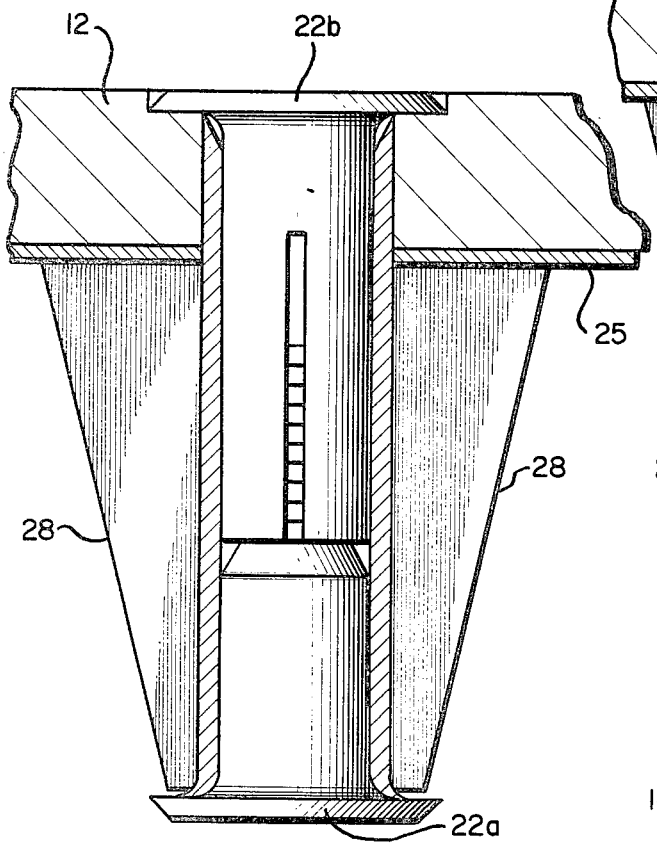
FIG. 6
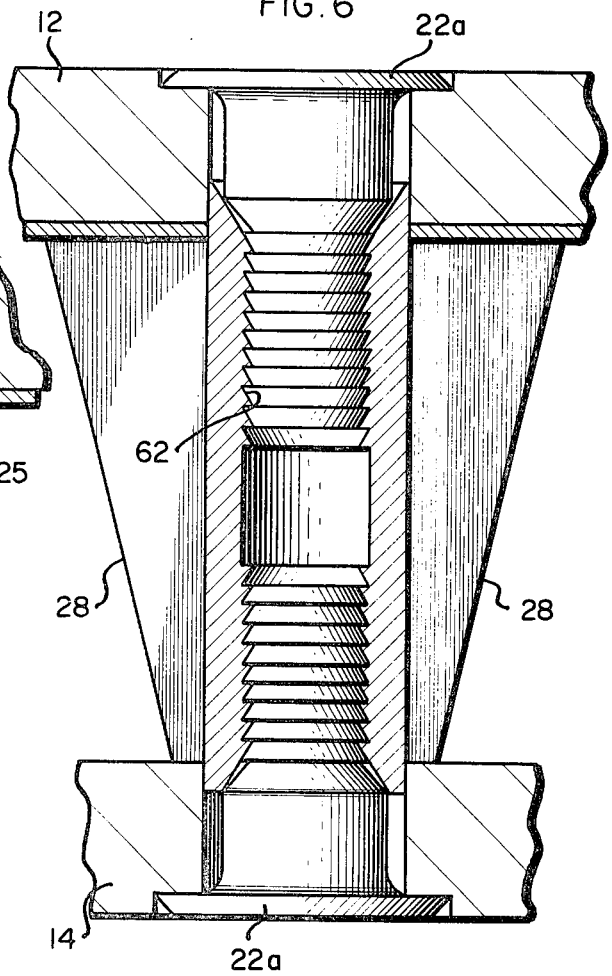

PALLET AND POST CONSTRUCTION THEREFOR

The present invention relates, generally, to an improved pallet and, more particularly, to an improved post construction for use in conjunction with pallets of various sorts.

In U.S. Pat. No. 4,128,253, the present applicant disclosed an improved pallet, and an improved post construction for use in conjunction with pallets. The post disclosed therein comprised an outer body and an inner body spaced from one another with a number of spaced apart flanges. The inner body extended from the outer body at at least one end of the post, so as to provide an extended portion which would be received in a hole formed in one of the platforms forming the pallet. The inner body has an axial bore extending through it, and the post is secured to a pallet by a rivet having an enlarged diameter base portion and a cylindrical shaft portion, when the shaft portion is extended through the hole in the platform into the axial bore in the inner body of the post. If the pallet included both an upper and a lower platform, the assembly is secured together by a similar rivet extended through a hole in the lower platform into the axial bore in the inner body of the post. In certain applications, a cylindrical roller is provided and secured about the outer body so as to be rotatable thereabout to provide additional advantages to the pallet constructions.

While the pallet and the post construction disclosed in this patent both are of exceptional quality and provide many advantages over other prior existing pallets and/or post constructions, it is found that for many applications a less expensive, expendable post is desirable. In particular and for example, such a post is desired for use in conjunction with pallets having corrugated, pressboard or other lightweight, less sturdy platforms, in comparison to those having platforms of, for example, three-quarter inch plywood or the like. Yet, with these less sturdy platforms, it is desired to retain many of the advantageous features of the post construction diclosed in the above-mentioned patent.

The above objectives are provided by the post of the present invention which comprises, according to one embodiment, a truncated, cone-shaped outer body and a cylindrical-shaped inner body encompassed by the outer body and attached thereto by a plurality of spaced-apart flanges. The post has a top wall on the larger end of the cone-shaped outer body, and the inner body has a portion extending beyond the outer body at at least the end thereof having the top wall. The inner body also has an axial bore extending through it.

The post is secured to a pallet as in the above-identified patent, i.e., by extending the shaft portion of a rivet having an enlarged head through a hole in the pallet into the axial bore in the inner body of the post. The extend portion or portions of the inner body of the post are disposed within the holes in the pallet to provide additional support.

The pallet can include simply an upper platform, or both an upper and a lower platform. When the pallet has only an upper platform it is advantageous to affix to the lower, smaller end of the post one of the rivets. In this respect, it is further contemplated that the outer peripheral edge of the head portion of the rivet be provided with a beveled-edge so that the rivet's head functions generally as a skid or caster.

A further feature of the post is a slot formed in and preferably extending the length of the inner body. It is found that it is advantageous to provide a rivet having a shaft portion which has a diameter the same as the diameter of the axial bore in the inner body, to effectively eliminate any tolerances and thus sloppy fits. However, by the same token, it is found that doing so results in the stripping of the threads or serrations formed on the respective rivet members when the same are engaged to lockingly secure the posts to the pallets, or on the shafts of the rivets and the side walls of the inner body. The slot in the inner body provides sufficient relief to permit the rivets to be inserted without stripping these threads or serrations.

A truncated, cone-shaped sleeve also can be provided to function as a roller on the post, for the same reasons and advantages described in the above-referenced patent.

In accordance with a second embodiment of the invention, a similar post is provided but the side wall is eliminated so that only a plurality of fins radiate outwardly from the inner body. The peripheral edges of the fins effectively define a truncated, cone-shaped surface or body. The post is secured to a pallet in the same fashion as described above, and a truncated, cone-shaped roller can be provided for use with the post.

These truncated, cone-shaped posts retain many of the advantages and features of the posts described and claimed in the applicant's above-identified U.S. Pat. No. 4,128,253. In addition, they have the further advantage of being less costly. In fact, the cost is such that these posts are considered to be of the expendable type normally or generally used with less costly pallets which are discarded after an initial use, i.e., goods are stacked on such pallets for handling and shiping, and then discarded after the goods are removed from the pallets. The use thereof, however, is not limited to pallets of this type, for they can as well be used with the heavier pallets. The construction of the posts also is such that the sturdiness thereof is not substantially diminished in any respect, and the posts find many applications for use with various different types of pallets, as more fully described below.

DESCRIPTION OF THE DRAWINGS

FIG. 4 is a partial plan view of a pallet having only an upper platform, with a post affixed to it;

FIG. 5 is a partial plan view of a pallet having only an upper platform, and further illustrating a post constructed in accordance with another embodiment of the invention; and FIG. 6 is a view similar to FIG. 5, only in this case, the pallet has both an upper and lower platform.

DESCRIPTION OF THE PREFERRED EMBODIMENT OF THE INVENTION

Figure 1:
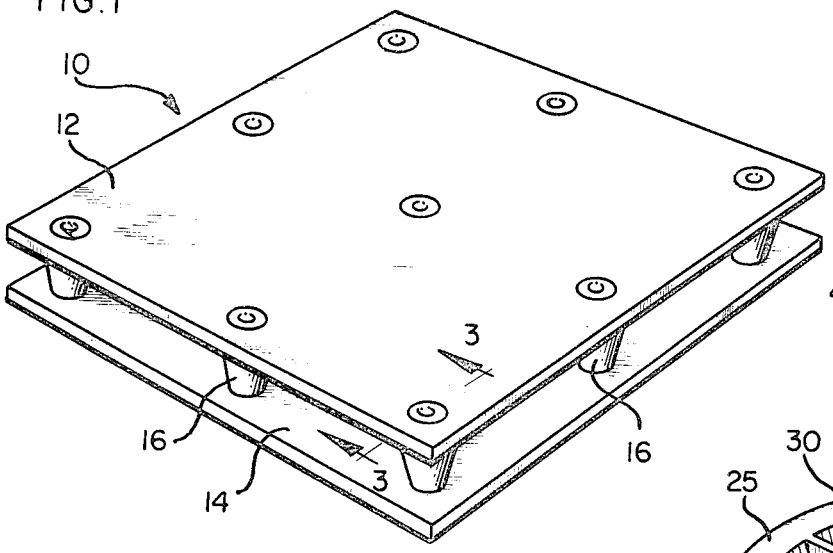
FIG. 1 is a perspective view of a pallet constructed in accordance with the invention.

Referring now to the drawings, in FIG. 1 there is illustrated a pallet 10 having an upper platform 12 and a lower platform 14 secured together in spaced apart relationship by means of a plurality of post assemblies 16. The upper platform 12 and lower platform 14 may be of any suitable material such as wood, plywood, pressboard or the like. In the embodiment illustrated in FIG. 1, there are nine post assemblies 16 secured between the upper platform 12 and the lower platform 14, however, a lesser number of post assemblies 16 could be used, depending upon the surface area of the platforms and the strength thereof.

Figure 2:
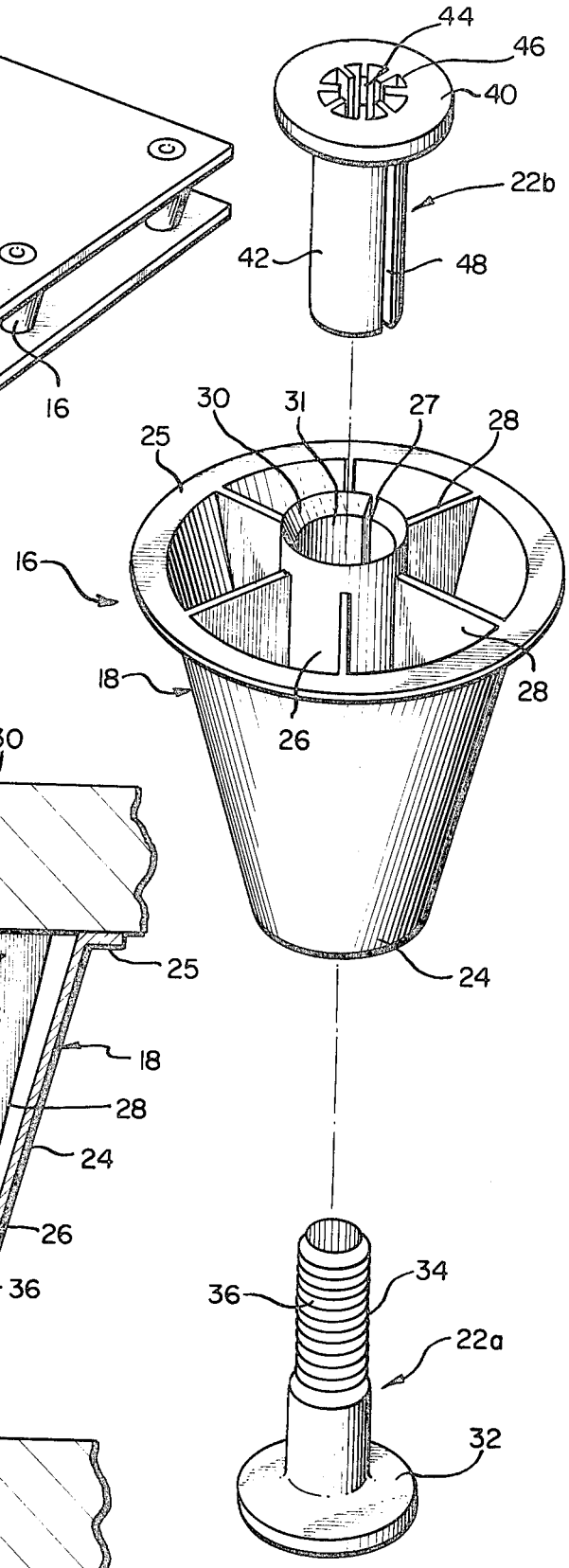
FIG. 2 is an exploded perspective view of a post constructed in accordance with one embodiment of the invention.
Figure 3:
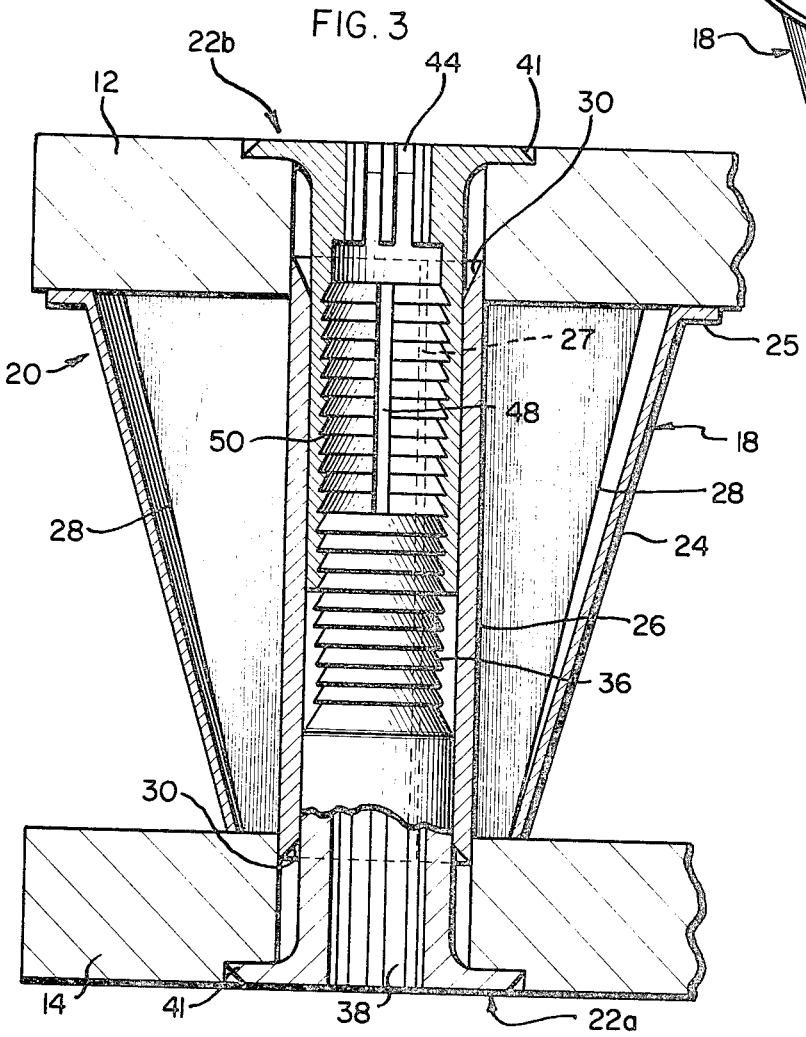
FIG. 3 is a partial plan view of a pallet, partially sectioned to illustrate the construction of the post of FIG. 2.

As can be best seen in FIGS. 2 and 3, each of the post assemblies 16 comprises a spacer 18 and a rivet 22, comprising a male rivet portion 22*a* and a female rivet portion 22*b*. A roller 20 also may be included as part of the assembly, as more fully described below. The entire post assembly 16 preferably and advantageously can be inexpensively molded of plastic, and the construction of the post assemblies 16 is such that it can be easily and quickly affixed to the pallet.

More particularly, the spacer 18 of the post assemblies 16 is of a truncated, cone-shaped construction and has an outer body or side wall 24, a top wall 25 and an inner cylindrical body 26 which is axially disposed and supported therein by means of a plurality of radial extending support fins or flanges 28. The inner body 26 has a bore 31 extending through it for receiving therein the rivet 22, as more fully described below. The length of the inner body 26 also is greater than the length of the outer body 24, for reasons which will be more apparent from the description below. A slot 27 is formed in the wall of the inner body 26, and preferably extends the entire length thereof, for reasons set forth more specifically below. Further still, the opposite terminal edges of the inner body 26 preferably and advantageously can be tapered as at 30 to provide a camming type surface for guiding the rivet 22 into the bore 31 in the inner body 26.

The roller 20 which can be provided as part of the post assemblies 16 is simply a hollow truncated cone-shaped member having an inner diameter just slightly larger than the outer diameter of the outer body 24 of the spacer 18, so that when assembled, the roller 20 can freely rotate about the spacer 18. Also, the length of the roller 20 is somewhat less than the length of the outer body 24 of the spacer 18 so that the roller 20 is freely retained about the spacer 18 when the post assemblies 16 are affixed to the upper platform 12 and the lower platform 14 of the pallet 10, as illustrated in FIG. 3.

The male rivet portion 22*a* of the rivet 22 has an enlarged diameter disc shaped base portion 32 and a cylindrical shaft portion 34 integrally formed therewith. The cylindrical shaft portion 34 has interlocking means 36 formed thereon. A bore 38 also extends through the cylindrical shaft portion 34 and the base portion 32.

The female rivet portion 22*b* likewise comprises an enlarged diameter disc shaped base portion 40 having a cylindrical shaft portion 42 integrally formed therewith. A bore 44 extends through the base portion 40 and the cylindrical shaft portion 42, and the walls of the bore 44 are provided with interlocking means 50, as can be best seen in FIG. 3. A plurality of inwardly extending radially disposed flanges 46 can be provided within the bores 38 and 44 to provide additional strength for the rivets 22, if desired. The peripheral edge of the base portions 32 and 40 advantageously are beveled as at 41, for reasons described more fully below. Also, the diameter of the shaft portion 34, and the shaft portion 42 when the interior wall of the inner body 26 is provided with interlocking means as described below, is preferably proportioned to correspond to the diameter of the interior bore 31 of the diameter of the interior bore 31 of the inner body 26 such that the tolerance between them is negligible.

The interlocking means 36 of the male rivet portion 22*a* and the interlocking means 50 of the female rivet portion 22*b* are complimentary interlocking means which lockingly engage to secure the male rivet portion 22*a* and the female rivet portion 22*b* together when the rivet 22 is assembled by extending the cylindrical shaft portion 34 into the bore 44.

The interlocking means 36 and 50 can be, for example, a plurality of serrations or barbs formed on the respective members which lockingly engage to prevent the rivet from subsequently separating. Alternatively, the interlocking means can be threads formed on the respective members so that the rivet 22 can be threadedly secured together. Irrespective of the type of interlocking means used, preferably and advantageously the interlocking means are such that the male rivet portion 22*a* and the female rivet portion 22*b* can be quickly and easily affixed together by simply forcibly inserting the cylindrical shaft portion 34 into the bore 44 of the female rivet portion 22*b*. In this respect, the slots 48 in the walls of the cylindircal shaft portion 42 of the female rivet portion 22*b* provides sufficient flexibility during assembly to permit the cylindrical shaft portion 34 to be forcibly inserted into the bore 34. The slot 27 also permits the rivet 22 to be lockingly engaged without stripping the interlocking means 36 and/or 50. Without this slot 27, in many cases, it is found that the interlocking means are stripped as a result of the zero tolerance fit. Once assembled, the interlocking means 36 and 50 lockingly engage to prevent the rivet 22 from subsequently separating.

In constructing the pallet 10, holes corresponding in number to the post assemblies to be affixed to the pallet 10, are formed in each the upper platform 12 and the lower platform 14. The holes formed in the platforms 12 and 14 obviously must be in alignment with one another, and the diameter of these holes preferably and advantageously substantially correspond to the diameter of the outside diameter of the inner body 26 of the spacer 18, so that the extended portion of the inner body 26 is snugly received within the holes formed in the platforms 12 and 14, as illustrated in FIG. 3. Also, preferably and advantageously, countersunk holes are provided in the platforms 12 and 14 for receiving therein the base portions 32 and 40 of the male rivet portion 22*a* and female rivet portion 22*b*, as illustrated in FIG. 3, so that ultimately these base portions are flush with the surfaces of the platforms 12 and 14, so that there are no projections above the surface of the platforms 12 and 14.

As can be seen in FIG. 3, the posts 16 are disposed between the upper platform 12 and the lower platform 14, with the extended portions of the inner body 26 projecting into the holes formed in the platforms 12 and 14. If a roller 20 is provided, it is rotatably disposed about the post 16. The upper platform 12 and the lower platform 14 are fixedly secured to the post assemblies 16 and the latter fixedly secured between the upper platform 12 and the lower platform 14 by extending the cylindrical shaft portion 34 and the cylindrical shaft portion 42 of the male rivet portion 22*a* and the female rivet portion 22*b* through the holes in the platforms 12 and 14 and into the bore 31 in the inner body 26 of the spacer 18. As can be seen in FIG. 3, the outer diameter of the cylindrical shaft portion 42 of the female rivet portion 22b corresponds with the inner diameter of the bore 31 in the inner body 26 of the spacer 18, so that the cylindrical shaft portion 42 is snugly received within the bore 31. The diameter of the cylindrical shaft portion 34 of the male rivet portion 22a corresponds to the diameter of the bore 44 in the female rivet portion 22b so that the interlocking means 36 and 50 on the respective rivet halves lockingly engage when the male rivet portion 22a and the female rivet portion 22b are forcibly urged together. The latter can be accomplished by, for example, by pressing or hammering one or the other of the male rivet portion 22a and female rivet portion 22b to forcibly urge the cylindrical shaft portion 34 into the bore 44.

In FIG. 4, the post assembly 16 is illustrated as it is affixed to only an upper platform 12. As can be seen, it is preferred to provide or use a rivet at the lower end of the post 16 to both close this end of the post and to function generally as a skid or caster on the bottom of the post. When the rivet is hammered into the post, the beveled edge on the lower end of the inner body 26 is crimped or flattened, as at 51, so as to provide a sturdier support shoulder for the rivet. If a roller 20 is provided, the rivet is provided with an enlarged diameter base portion (not shown), the diameter thereof being greater than the diameter of the smaller end of the roller 20 so that the latter is retained on and about the post 16 by means of the enlarged diameter base portion.

In FIG. 5, there is illustrated still another post assembly which is generally like the post assembly 16, however, in this embodiment, the side wall is eliminated and only the radially extending support flanges 28 are retained. A roller 20 still can be provided and, in this case, the roller 20 simply rotates about the peripheral edges of the flanges 28. Also, the top wall 25 advantageously is extended to cover the top of the spacer 18 to provide additional support for the fins or flanges 28. In other words, a full top wall 25 is provided, and the upper extended portion of the inner body 26 extends through the top wall.

In FIG. 6, there is illustrated still another post assembly 60 which is adapted to be affixed to an upper platform 12 or between an upper platform 12 and a lower platform 14. In this case, two male rivet portions 22a are used, and the bore 31 in the inner body 26 is formed and provided with interlocking means 62 for lockingly engaging with the male rivet portions 22a when the cylindrical shaft portions 34 thereof are forcibly inserted into the bore 31. Otherwise, the construction and the assembly of the post assembly is the same as described above.

It will thus be seen that the objects set forth above, among those made apparent from the preceding description, are efficiently attained and certain changes may be made in the above article. Accordingly, it is intended that all matter contained in the above description or shown in the accompanying drawings shall be interpreted as illustrative and not in a limiting sense.

Now that the invention has been described, what is claimed as new and desired to be secured by Letters Patent is:

1. A post for use in combination with a pallet having at least an upper platform with a plurality of holes formed in it, said post comprising, in combination, an inner body, a plurality of flanges extending outwardly from said inner body, the peripheral edges of said flanges defining a truncated, cone-shaped surface about said post, a top wall on at least the larger end of said post, said inner body having a portion extending beyond said flanges at at least the top wall end thereof and having an axially aligned bore extending through it, the extended portion of said inner body being disposable within the respective ones of said holes in said upper platform, and a rivet having an enlarged diameter base portion and a cylindrical shaft portion formed integrally therewith, said cylindrical shaft portion being proportioned to extend through a respective one of said holes in said upper platform and into said bore in said body of said post, complimentary interlocking means on said cylindrical shaft portion of said rivet and on the side wall of said bore in said inner body which interlock to fixedly and replaceably secure said post to said upper platform; and a slot in said inner body extending the longitudinal length thereof for providing sufficient relief to permit said rivet to be inserted into said bore in said body without stripping said interlocking means.

2. The post of claim 1, wherein said pallet further includes a lower platform having formed therein a corresponding number of holes aligned with said holes in said upper platform, said post being disposed between said upper and lower platforms for securing them together in spaced apart relationship, said inner body of said post having a portion extending beyond said flanges at each end thereof, the extended portions of said inner bodies being disposed within the respective ones of said aligned holes in said upper and lower platforms respectively, and a rivet extending through each of said aligned holes formed in the respective upper and lower platforms and into said bore in said inner body of said post to secure said upper and lower platforms to said posts.

3. The post of claim 2, further comprising a side wall spaced from said inner body and supported by said plurality of flanges, said side wall being a truncated cone-shaped side wall.

4. The post of claim 3, wherein said top wall comprises a rim at the larger end of said post affixed to and radiating outwardly from said side wall, whereby the top of said post interiorly of said side wall is open.

5. The post of claim 2, wherein said rivet comprises a male rivet portion and a female rivet portion having complimentary interlocking means thereon for fixedly securing said male and female rivet portion together, said slot in said inner body providing sufficient relief to prevent said interlocking means from being stripped during assembly.

6. A pallet comprising at least an upper platform and a plurality of posts for supporting said upper platform in spaced relationship to a support surface, said upper platform having formed therein a number of holes corresponding in number to the posts secured thereto, said posts each comprising an inner body, a plurality of flanges extending outwardly from said inner body, the peripheral edges of said flanges defining a truncated, cone-shaped surface about said post, a top wall on at least the larger end of said post, said inner body having a portion extending beyond said flanges at at least the top wall end thereof and having an axially aligned bore extending through it, the extended portion of said inner body being disposed within the respective ones of said holes in said upper platform, and a plurality of rivets each having an enlarged diameter base portion and an axially aligned cylindrical shaft portion formed integrally therewith, said cylindrical shaft portion of each said rivet being extended through a respective one of said holes in said upper platform and into said bore in said inner body of a corresponding post, complimentary interlocking means on said cylindrical shaft portion of said rivet and on the side wall of said bore in said inner body which interlock to fixedly and replaceably secure said post to said upper platform; and a slot in said inner body extending the longitudinal length thereof for providing sufficient relief to permit said rivet to be inserted in said bore in said body without stripping said interlocking means.

7. The pallet of claim 6, further including a lower platform having formed therein a corresponding number of holes aligned with said holes in said upper platform, said post being disposed between said upper and lower platforms for securing them together in spaced apart relationship, said inner body of said post having a portion extending beyond said flanges at each end thereof, the extended portions of said inner bodies being disposed within the respective ones of said aligned holes in said upper and lower platforms respectively, and a rivet extending through each of said aligned holes formed in the respective upper and lower platforms and into said bore in said inner body of said post to secure said upper and lower platforms to said posts.

8. The pallet of claim 7, wherein said posts further comprise a side wall spaced from said inner body and supported by said plurality of flanges, said side wall being a truncated cone-shaped side wall.

9. The pallet of claim 8, wherein said top wall on said posts comprises a rim at the larger end of said post affixed to and radiating outwardly from said side wall, whereby the top of said post interiorly of said side wall is open.

10. The pallet of claim 6, wherein said rivet comprises a male rivet portion and a female rivet portion having complimentary interlocking means thereon for fixedly securing said male and female rivet portions together, said slot in said inner body preventing said interlocking means from being stripped during assembly.

* * * * *